United States Patent [19]

Peterson

[11] Patent Number: 4,557,388

[45] Date of Patent: Dec. 10, 1985

[54] AGRICULTURAL ROLL FOR CONVEYING AND SORTING MACHINES

[76] Inventor: Soren E. Peterson, 1649 W. 3300 S., West Valley City, Utah 84119

[21] Appl. No.: 628,858

[22] Filed: Jul. 9, 1984

[51] Int. Cl.[4] ..... B07B 13/04

[52] U.S. Cl. ..... 209/671; 198/780; 29/121.6; 209/931

[58] Field of Search ..... 209/671, 931, 667, 618; 29/121.5, 121.6, 124, 132, 129.5; 198/780

[56] References Cited

U.S. PATENT DOCUMENTS

| | | | |
|---|---|---|---|
| 2,266,506 | 12/1941 | Morse | 198/780 X |
| 2,335,594 | 11/1943 | Kerr | 29/121.6 |
| 2,949,189 | 8/1960 | Haines | 209/671 |
| 3,519,129 | 7/1970 | Peterson | 209/671 |

FOREIGN PATENT DOCUMENTS

| | | | |
|---|---|---|---|
| 925134 | 3/1955 | Fed. Rep. of Germany | 209/671 |

*Primary Examiner*—Richard J. Johnson
*Attorney, Agent, or Firm*—M. Ralph Shaffer

[57] ABSTRACT

An improved agricultural machine roll of the tapered revolving type wherein such tapered roll has a series of ribs forming a frusto-conical traction surface. The upper extremity of these ribs have provided, at least proximate thereto, a series of nubs that are located proximate the greatest circumferential dimension of the roll and which extend radially outwardly beyond such ribs. The reduced end of the roll is prefereably thickened so as to reduce chances of fracturing of material proximate the axial hole with which the roll is provided. There will likewise be supplied protuberance means, spaced from said nubs, which are directed essentially radially outwardly beyond the lower portions of the ribs. These will be less in number than the ribs and are designed to impinge upon potatoes or other agricultural pockets so as to lift upwardly and advance forwardly the potatoes, for example, should the rib traction surface become slick as by filling with dirt, mud or other debris.

7 Claims, 4 Drawing Figures

AGRICULTURAL ROLL FOR CONVEYING AND SORTING MACHINES

FIELD OF INVENTION

The present invention relates to revolving rolls in agricultural machines such as sorters, cutters, and the like, and more particularly, to a new and improved tapered agricultural roll wherein means are provided for both assisting the cradling of agricultural products such as potatoes, while in transit, and also for providing the necessary protuberances for advancing such potatoes, for example, and also for lifting the same from their roll pockets should the latter become slick, i.e. of reduced friction.

BRIEF DESCRIPTION OF PRIOR ART

In the past many tread-type, tapered friction rolls have been developed, among which has been that described in the inventor's prior U.S. Pat. No. 3,519,129. The latter patent is believed the most developed in the art, and wherein a series of tapered ribs are provided as a traction surface for potatoes to be cradled in advance for sorting, cutting, or other purposes. A plurality of nubs are also provided and which extend beyond the outer periphery of the ribs. These nubs are located centrally of a double-sided tapered roll, for example, the nubs extending essentially radially beyond the outer dimension of the ribs at this area.

A still further improvement in this design is possible by the inclusion of protuberance means located proximate the reduced end of the roll, the protuberance means being less in number than the ribs and extending beyond the ribs of this area only a small distance, i.e., much lower than the circumferential locus of the ends of the nubs at the enlarged portion of the roll.

These protuberances are intended to engage under surfaces of agricultural products such as potatoes so as to lift these slightly upwardly and advance the same forwardly where potatoes, especially small ones, tend to be retained in the pockets against the ribbed traction surfaces which might become filled with debris such as mud, dirt, and so forth. In other words, the inclusion of such protuberances acts as an aid to potato advancement through the impingement by such protuberance means of potatoes or other agricultural products when the same are nesting in one of successive pockets designed to receive the potatoes, which pockets are formed by adjacent pairs of the rolls as mounted on adjacent shafts. None of the art known to the inventor teaches the inclusion of such protuberances as above described proximate the lower areas of the potato pockets, i.e., the lower areas of the individual rolls.

BRIEF DESCRIPTION OF THE PRESENT INVENTION

Accordingly, the present invention consists of rolls which are either single or double tapered, which rolls include ribs having a declining configurement and which are mutually spaced along the essentially conical configurement of the roll surface. Proximate the greatest dimension of the roll will be outwardly directed nubs which proceed beyond the outer surfaces of the ribs, and which are designed to carry potatoes or other agricultural products, especially large items, forwardly from pocket to pocket as formed by adjacent pairs of rolls as mounted on adjacent machine shafts. The roll again may be single tapered or double tapered, with single tapered rolls being pressed together to form pockets as may be suitable, and other single tapered rolls being used as extremities of roll aggregations or combinations on respective machine shafts. The reduced diameter areas of the individual rolls are provided with upwardly extending protuberances or lugs which extend above the general contour of the ribs which will be substantially lower than the locus of the nubs at the greatest circumferential dimension of the roll. In this way the protuberances will be reduced in height so as not to interfere with general transport of large potatoes, for example, but urge forwardly smaller potatoes as might nestle in a slick potato-receiving pocket, as formed by adjacent pairs of rolls, wherein the tread or inter-rib area is filled with mud or debris; the small protuberances, thus, are free to lift and advance, through impingement, potatoes nestled in these pockets so as to advance the same forwardly and overcome the slick, non-friction-like character of the rolls at the tread area.

OBJECTS

Accordingly, a principal object of the present invention is to provide a new and improved agricultural machine.

A further object is to provide rolls for an agricultural machine which will be effective to align and advance agricultural products such as potatoes along successive pockets as formed by adjacent pairs of rolls as mounted on adjacent shafts of machine.

An additional object is to provide an improved agricultural roll wherein the same, in addition to including a tread as formed by ribs, for example, will also include peripheral nubs which are mutually spaced along the large circumference of the roll the reduced end of the roll being provided, at or near such end, upwardly standing protuberances which do not proceed nearly so high as the nubs but which will be effected to impinge upon and lift potatoes, particularly small ones for example, which are lodged in potato pockets and against the ribbed tread area of particular rolls.

BRIEF DESCRIPTION OF THE DRAWINGS

The present invention, both as to its organization and manner of operation, will best be understood by reference to the following detailed description, taken in conjunction with the following drawings, in which:

in FIG. 2 the roll may be either double tapered as indicated, or a pair of half rolls or single tapered rolls may be pressed together on the same shaft to form the double tapered roll indicated; it will be understood that single tapered rolls may be used at the ends of each assemblage of rolls on a particular shaft.

DETAILED DESCRIPTION OF PREFERRED EMBODIMENTS

Figure 1:
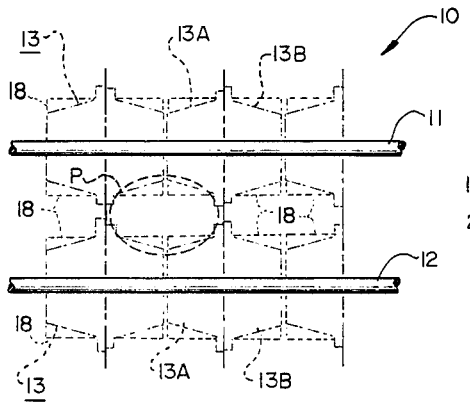
FIG. 1 is a top plan of a portion of an agricultural roll machine incorporating several parallel revolving shafts two of which are shown, and upon which shafts are mounted a series of tapered revolving agricultural rolls shown generically in phantom line and indicating their general orientation.

In FIG. 1 agricultural machine 10 may be a grader, sorter, cutter type machine and so on and, in any event, will include a plurality of shafts generally disposed in a horizontal plane two such shafts being shown at 11 and 12. Each of the shafts will include a series of rolls 13 which are either double tapered as seen at the left in FIG. 1 or single tapered halves that are pressed together on the respective shaft. It will be noted that the rolls are aligned relative to adjacent shafts so as to form a series of potato receiving pockets P. Potatoes used herein is for purposes of illustration only; it will be understood that onions or other types of agricultural produce may be accommodated. The bed of the machine which includes the series of shafts 11 and 12, and so forth, upon which the rolls are mounted, will be used to align the potatoes and advance the same forwardly. Suitable apparatus, not shown, will couple the shafts together so that they sequentially revolve in a similar manner and direction.

Figure 2:
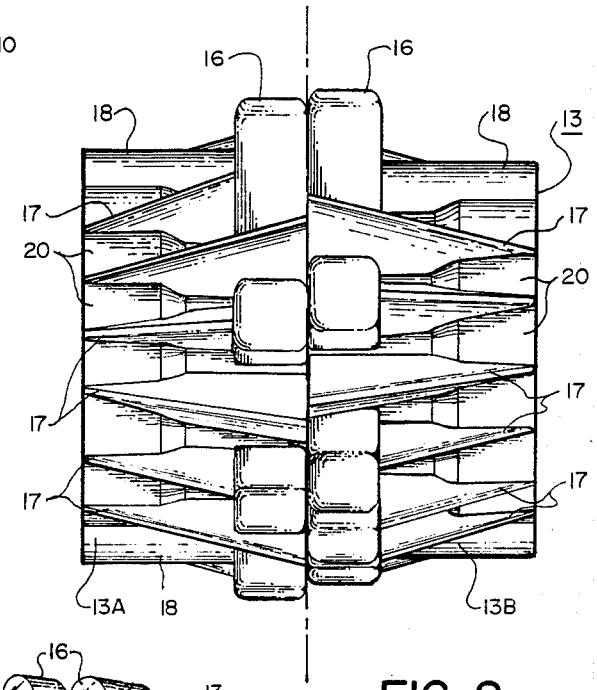
FIG. 2 is an enlarged plan view of a representative roll shown in FIG. 1.
Figure 3:
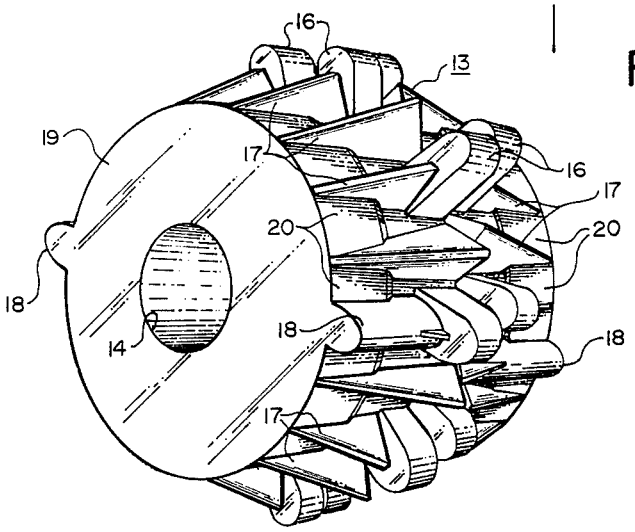
FIG. 3 is an enlarged perspective view of the improved agricultural tapered roll seen in FIG. 2.

FIGS. 2 and 3 illustrate a representative tapered roll which, as shown, is double tapered. In FIG. 2 the central vertical line indicates that this may be a junction as between a pair of single tapered rolls which are simply pushed together along their major circumferences. In any event, the rolls 13, whether unitary or comprised of roll halves 13A and 13B, are shown to include an axially central aperture 14 which may be either circular as seen in FIG. 3 or rectangular and preferably square as seen at aperture 15 in FIG. 4, the latter accommodating shafts of rectangular or square cross-section.

In any event, nubs 16 will be provided proximate the large or greatest circumferential dimension of the roll, these nubs being spaced apart so as to catch and advance long potatoes, i.e., those which may not otherwise be advanced properly by the primary tread. The tread itself is composed of a series of ribs 17 that are mutually spaced apart and preferably configured as angles or triangles as indicated. These ribs 17 form the primary traction for medium sized agricultural produce items such as medium sized No. 1 russet potatoes, for example. If desired, the space between the ribs may be filled at area 17 so as to enhance material strength proximated the end 19 of the roll.

Of importance is the inclusion of upstanding protuberances 18, these being less in number than the ribs and generally less likewise than the number of nubs included on the outer or central circumference of the roll. These protuberances 18 can be semicylindrical in shape and actually be molded into the roll design. It is seen that these advance essentially radially outwardly beyond the orientation of the triangularly shaped ribs proximate in 19. This is to say, the protuberances 18 will extend outwardly beyond the general orientation of the ribs at this point. This is so that any potatoes or other agricultrual produce items that may be disposed in pockets P, see FIG. 1, will be urged upwardly and advanced forwardly by protuberances 18 so as to aid in the advancement of these items forwardly over the bed of the machine in accordance with the forward rotation of the upper surfaces of shafts 11 and 12, by way of example.

Figure 4:
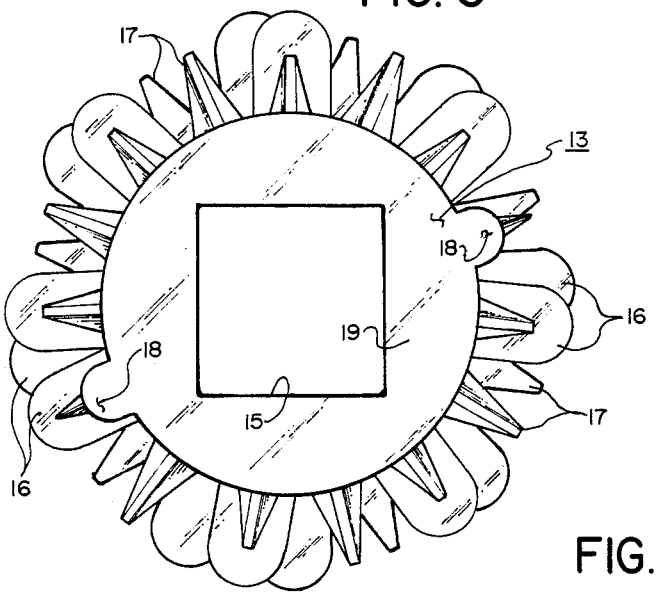
FIG. 4 is an end view of the roll of FIG. 3 but wherein the interior shaft aperture is rectangular rather than round.

The filling 20 of the material between the ribs, or simply rendering the end portion proximate at 19 solid, will reduce tendencies of fracturing the material especially where enlarged, rectangular or square holes are used as at 15 in FIG. 4, this for shaft mounting purposes.

Accordingly, what is provided is a new and improved tapered roll for agricultural machines wherein the ribbed tread portion of such roll is provided with upstanding protuberance means proximate the reduced end of the roll so as to aid in proper revolvement and progress of agricultural items where the primary tread becomes slick, mud-filled, or otherwise incapable of supplying proper traction and frictional force to the agricultural items entering into the pockets P formed by such rolls.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. An elastomeric tapered roll provided with a central, axial shaft aperture; a series of longitudinally elongate, mutually-spaced sloping ribs forming a frustoconical friction surface; plural, mutually spaced nubs extending outwardly beyond said ribs proximate the roll's largest regular circumferential dimension; and longitudinally elongate protuberance means, parallel to said shaft aperture, interpositioned between selected ones of said ribs and extending radially outwardly beyond said ribs proximate said roll'smallest regular circumferential dimension.

2. The structure of claim 1 wherein extrapolations of said ribs proximate said roll's smallest circumferential dimension include fill material therebetween, whereby to provide a thickened end for said roll.

3. The structure of claim 2 wherein the transverse cross-section of said aperture is round.

4. The structure of claim 2 wherein the transverse cross-section of said aperture is rectangular.

5. The structure of claim 2 wherein the transverse cross-section of said aperture is non-circular.

6. An agricultural machine revolvable roll having a peripheral apex, essentially defined by a series of outwardly extending mutually spaced nubs; and opposite, oppositely conically tapered sides terminating in opposite respective ends, said roll having an axial shaft aperture passing through said ends, said sides having a series of longitudinally oriented, radially inwardly sloping surface ribs and also outwardly projecting longitudinally elongate protuberances interposed between selected ones of said ribs and proximate said ends and projecting above adjacent one of said ribs at areas proximate said ends and being essentially equidistant from said apex.

7. An agricultural machine roll having a general, frustoconical shape provided with large and small ends; a series of longitudinal, mutually spaced ribs disposed about said rolls intermediate said ends; a series of nubs, less in number than said ribs, projecting essentially radially outwardly peripherally about said large end; protuberance means at least in part projecting above said ribs proximate said small end, said roll being provided with an axial shaft aperture disposed through and between said ends.

* * * * *